US008449267B2

(12) United States Patent
Pascual et al.

(10) Patent No.: US 8,449,267 B2
(45) Date of Patent: May 28, 2013

(54) PUMP ASSEMBLY AND FLUID METERING UNIT

(75) Inventors: Joseph A. Pascual, Lake Forest, CA (US); Nalin Kamboya, Yorba Linda, CA (US); Jonathan Dinh, Orange, CA (US); Mark DeBrito, Coquille, OR (US)

(73) Assignee: SHURflo, LLC, Cypress, CA (US)

( * ) Notice: Subject to any disclaimer, the term of this patent is extended or adjusted under 35 U.S.C. 154(b) by 967 days.

(21) Appl. No.: 10/952,703

(22) Filed: Sep. 29, 2004

(65) Prior Publication Data

US 2006/0073036 A1 Apr. 6, 2006

(51) Int. Cl.
*F04B 1/12* (2006.01)

(52) U.S. Cl.
USPC ..... 417/269; 417/395; 91/499

(58) Field of Classification Search
USPC ..... 417/269, 395, 412, 413.1; 91/499
See application file for complete search history.

(56) References Cited

U.S. PATENT DOCUMENTS

| | | | |
|---|---|---|---|
| 1,338,852 | A | 5/1920 | Burnham |
| 1,819,966 | A | 8/1931 | Olson |
| 2,797,647 | A | 7/1957 | Floraday |
| 2,991,723 | A | 7/1961 | Zubaty |
| 3,435,679 | A | 4/1969 | Davis |
| 3,720,106 | A | 3/1973 | Varga |
| 3,802,266 | A | 4/1974 | Rittenhouse et al. |
| 3,835,706 | A | 9/1974 | Varga |
| 3,994,168 | A | 11/1976 | Varga |
| 4,153,391 | A | 5/1979 | Hartley |
| 4,396,357 | A | 8/1983 | Hartley |
| 4,425,837 | A | 1/1984 | Livesay |
| 4,610,605 | A | 9/1986 | Hartley |
| 4,848,164 | A | 7/1989 | Quarve et al. |
| 5,251,149 | A | 10/1993 | Williams et al. |
| 5,316,447 | A | 5/1994 | Fujii et al. |
| 5,370,506 | A | 12/1994 | Fujii et al. |
| 5,476,367 | A | 12/1995 | Zimmermann et al. |
| 5,546,801 | A | 8/1996 | Swinson et al. |
| 5,571,000 | A | 11/1996 | Zimmermann et al. |
| 5,626,464 | A | 5/1997 | Schoenmeyr |
| 5,659,300 | A | 8/1997 | Dresselhuys et al. |
| 5,791,882 | A | 8/1998 | Stucker et al. |
| 5,816,133 | A | 10/1998 | Schoenmeyr |
| 6,048,183 | A | 4/2000 | Meza |
| 6,089,838 | A | 7/2000 | Schoenmeyr |
| 6,299,414 | B1 | 10/2001 | Schoenmeyr |
| 6,474,132 | B1 | 11/2002 | Hathaway et al. |
| 6,581,458 | B1 | 6/2003 | Hathaway et al. |
| 6,611,769 | B2 | 8/2003 | Olson |
| 6,623,245 | B2 | 9/2003 | Meza et al. |
| 6,733,248 | B2 | 5/2004 | Lynn |
| 7,013,793 | B2 | 3/2006 | Dang |
| 2003/0209138 | A1 | 11/2003 | Schoenmeyr et al. |
| 2004/0009075 | A1 | 1/2004 | Meza et al. |

*Primary Examiner* — Charles Freay
*Assistant Examiner* — Patrick Hamo
(74) *Attorney, Agent, or Firm* — Greenberg Traurig, LLP

(57) ABSTRACT

Apparatus for a pump assembly and a fluid metering unit. The pump assembly can include a diaphragm with a portion of a body being molded over a portion of each one of a plurality of pistons. The pump assembly can include a wobble plate, a lower housing, and a spring positioned between the wobble plate and the lower housing. A valve housing can include pumping chambers with side walls that are angled. The fluid metering unit can include a bayonet locking mechanism and/or a seal between a housing and a flow meter. The controller can be calibrated according to the type and/or temperature of the fluid.

5 Claims, 10 Drawing Sheets

PUMP ASSEMBLY AND FLUID METERING UNIT

BACKGROUND

Wobble-plate pumps are employed in a number of different applications and operate under well-known principals. In general, wobble-plate pumps typically include pistons that move in a reciprocating manner within corresponding pump chambers. In many cases, the pistons are moved by a cam surface of a wobble plate that is rotated by a motor or other driving device. The reciprocating movement of the pistons pumps fluid from an inlet port to an outlet port of the pump.

In many conventional wobble plate pumps, the pistons of the pump are coupled to a flexible diaphragm that is positioned between the wobble plate and the pump chambers. In such pumps, each one of the pistons is an individual component separate from the diaphragm, requiring numerous components to be manufactured and assembled. A convolute is sometimes employed to connect each piston and the diaphragm so that the pistons can reciprocate and move with respect to the remainder of the diaphragm.

In some applications, such as applications in which chemicals or any type of fluid commodity is being sold, it is necessary to measure the amount of fluid flowing through a pump. Meters have been designed to measure fluid flow through a pump.

SUMMARY OF THE INVENTION

Some embodiments of the present invention provide a pump including a pump housing, valves, and a diaphragm. The diaphragm can include a body, pistons coupled to the body, each one of the pistons being positioned in an opening, and the body being molded over a portion of each one of the pistons in order to secure the pistons.

In some embodiments, the pump can include a drive assembly having a wobble plate, a diaphragm, a lower housing, and a spring positioned between the wobble plate and the lower housing.

The pump can include a valve housing coupled to a diaphragm. In one embodiment, the valve housing can include pumping chambers with each one of the pumping chambers including a side wall. The side wall can be angled so that a cross-sectional area of an opening of each one of the pumping chambers increases as the side wall tapers outwardly.

Some embodiments of the invention provide a fluid metering unit for measuring an amount of fluid flowing through a pump. The fluid metering unit can include a flow meter that measures the amount of the fluid and generates a signal. The fluid metering unit can also include a housing having a inlet port and an outlet port, the flow meter positioned to receive the fluid from the inlet port, to measure the amount of the fluid, and to emit the fluid to the outlet port. The housing can also include at least one flange. In addition, the fluid metering unit can include a controller that receives the signal from the flow meter. The controller can include at least one extension that engages the flange(s) of the housing.

In one embodiment, a seal can be coupled to an outlet port of the flow meter and secured between the outlet port of the flow meter and an outlet port of the housing.

In some embodiments, the controller of the fluid metering device can operate according to a calibration mode in order to calibrate the fluid metering unit for fluid type and/or fluid temperature.

Further objects and advantages of the present invention, together with the organization and manner of operation thereof, will become apparent from the following detailed description of the invention when taken in conjunction with the accompanying drawings.

BRIEF DESCRIPTION OF THE DRAWINGS

The present invention is further described with reference to the accompanying drawings, which show one embodiment of the invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 1:
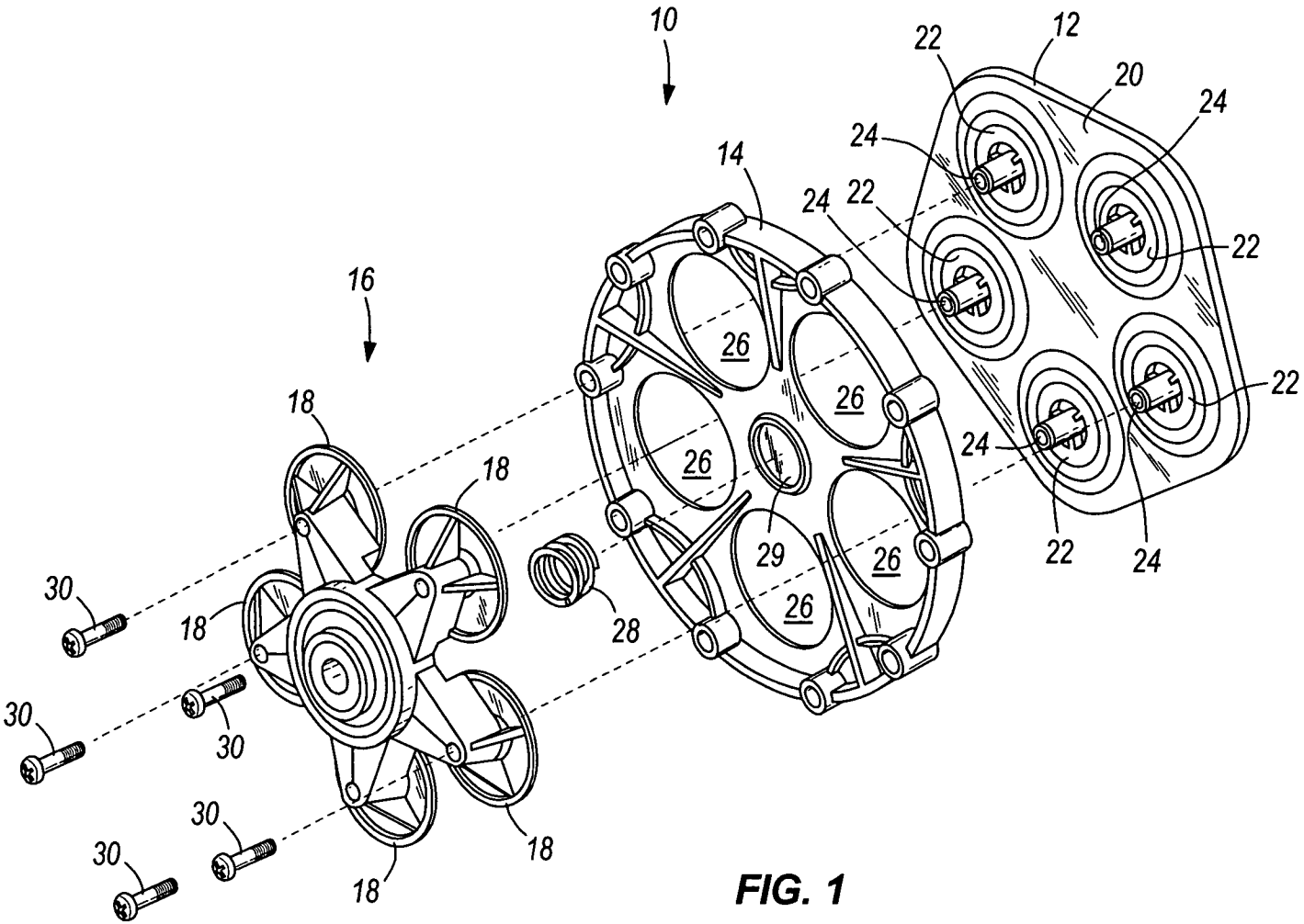
FIG. 1 is an exploded perspective view of a drive and diaphragm assembly according to one embodiment of the invention for use with a pump.
Figure 11:
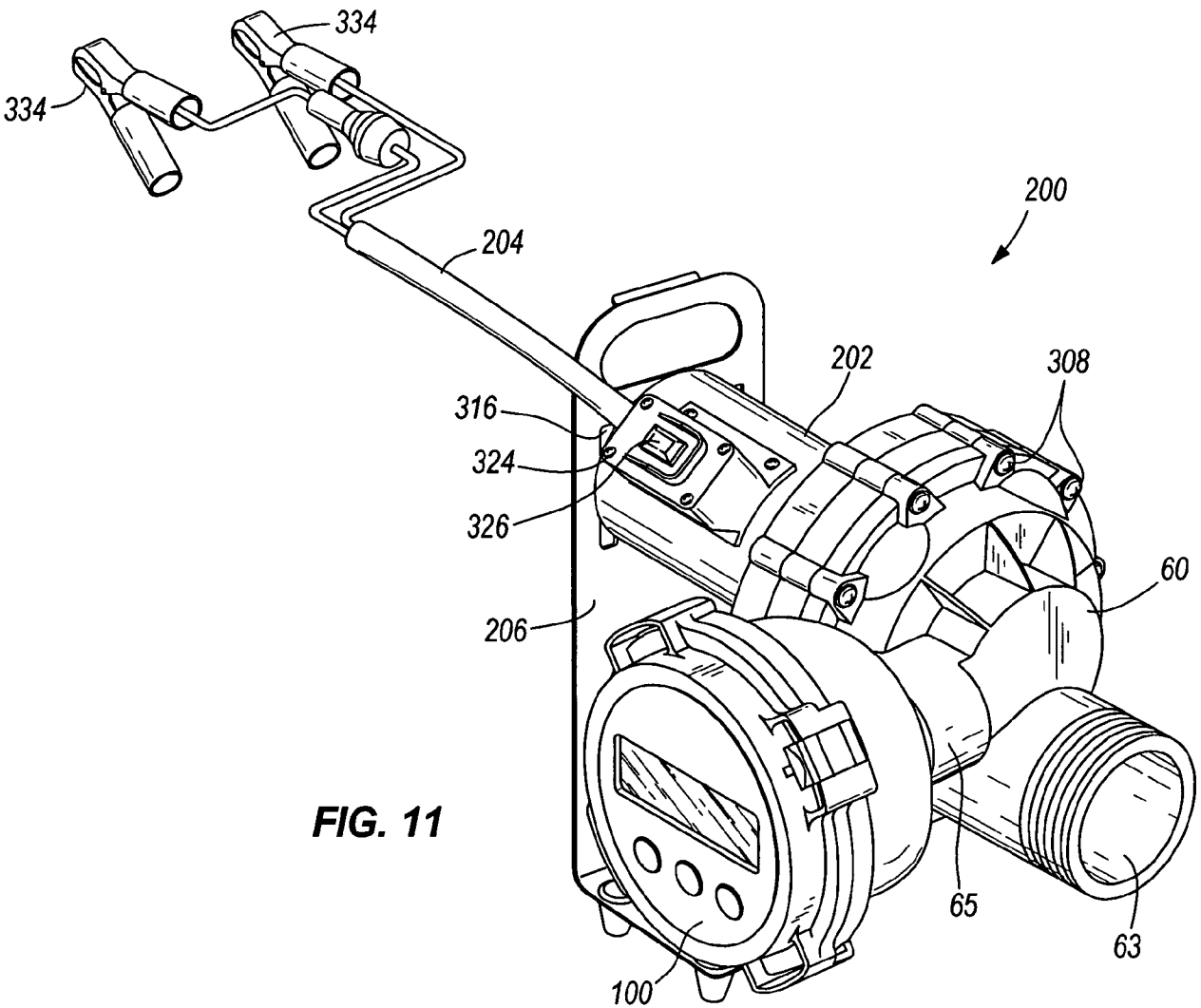
FIG. 11 is a perspective view of a pump according to one embodiment of the invention.

FIG. 1 illustrates a drive and diaphragm assembly 10 according to one embodiment of the invention. The drive and diaphragm assembly 10 can be used in a wobble-plate pump (as shown in FIG. 11) or any other suitable type of pump. Although the drive and diaphragm assembly 10 is shown and described herein as having five pumping chambers, the drive and diaphragm assembly 10 can have any number of chambers, such as two chambers, three chambers, or six chambers.

The drive and diaphragm assembly 10 can include a diaphragm 12, a lower housing 14, and a wobble plate 16. The diaphragm 12 can include a main body 20 and pistons 22. Each piston 22 can include a piston stem 24. The lower housing 14 can include openings 26 through which the piston stems 24 can be positioned. The openings 26 can be circular in order to receive circular pistons 22. However, the pistons 22 and the corresponding openings 26 can have other suitable shapes, such as tear-drop, rectangular, or elongated.

The pistons 22 of the diaphragm 12 can be coupled to the wobble plate 16 so that the pistons 22 are actuated by movement of the wobble plate 16. Any wobble plate arrangement and connection can be used to actuate the pistons 22 of the diaphragm 12. In some embodiments, the wobble plate 16 has several rocker arms 18 that transmit force from the center of the wobble plate 16 to locations adjacent to the pistons 22. Any number of rocker arms 18 can be used to drive the pistons 22, depending upon the number and arrangement of the pistons 22. The rocker arms 18 of the wobble plate 16 can engage the piston stems 24 of the diaphragm 12. Each one of the rocker arms 18 can engage a corresponding one of the piston stems 24 in a rotational sequence in order to pump fluid through pumping chambers. The wobble plate 16 can be secured to the diaphragm 12 with several fasteners, such as screws 30. Each screw 30 can be positioned through each rocker arm 18 and can be secured to each piston stem 24. The pumping chambers are located on the opposite side of the piston stems 24 and the screws 30, so that, in some embodiments, no metal is located in the fluid paths of the pumping chambers. The pistons 22 can instead be attached to the wobble plate 16 in any other suitable manner, such as by nut and bolt sets, other threaded fasteners, rivets, by adhesive or cohesive bonding material, or by snap-fit connections.

As shown in FIG. 1, a spring 28 can be positioned between the lower housing 14 and the wobble plate 16. The lower housing 14 can include a recessed portion 29 that receives one end of the spring 28. The wobble plate 16 can also include a raised portion (not shown) that receives the other end of the spring 28. The spring 28 can pre-load the drive and diaphragm assembly 10. In other words, the spring 28 can force the wobble plate 16 into abutment with motor bearings (not shown). In addition, the spring 28 can allow the pump to self-compensate for high pressure in the pumping chambers. In some embodiments, the spring 28 can absorb shocks, can dampen pulsation, can reduce noise, can improve efficiency, can improve priming capability when the pump is initially turned on, and/or can keep the drive and diaphragm assembly 10 aligned properly.

Figure 2:
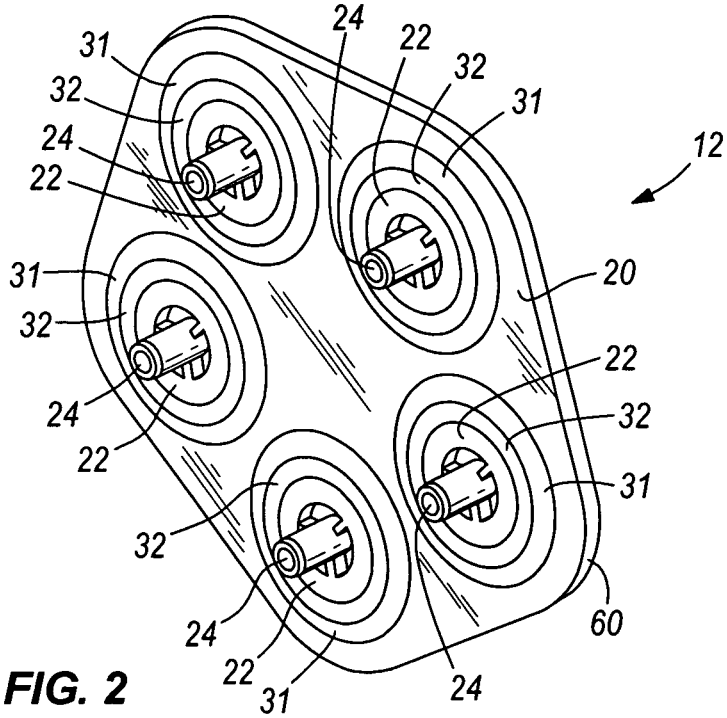
FIG. 2 is a perspective view of a diaphragm for use in the drive and diaphragm assembly of FIG. 1.

FIG. 2 further illustrates the diaphragm 12. The diaphragm 12 can include convolutes 31 corresponding to each one of the pistons 22. The convolutes 31 couple the pistons 22 to the main body 20 of the diaphragm 12. The convolutes 31 can allow the pistons 22 to move reciprocally without placing damaging stress upon the diaphragm 12. In some embodiments, the convolutes 31 can be angled for a "flat on upstroke" (i.e., the upstroke of the piston 22 is flat). Angled convolutes can, in some embodiments, improve the compression ratio of the pump, can decrease air entrapment, can improve priming capability, and can improve overall efficiency. The pistons 22 can be integrally connected to the main body 20 of the diaphragm 12. In other words, the main body 20 and the pistons 22 can be assembled into the pump as a single part and can be sold or inventoried as a single part.

In order to secure the pistons 22 with respect to the diaphragm 12, the material of the diaphragm 12 (e.g., a thermoplastic elastomer) can be molded over the edges of the pistons 22. The overmolding of the main body 20 can create two circular flanges 32 (for each pumping chamber, one on each side of the main body 20) between which each of the pistons 22 can be positioned and secured. Overmolding the diaphragm 12 to secure the pistons 22 results in easier assembly and fewer parts in inventory. Also, the main body 20 being molded over the pistons 22 helps prevent there from being a direct leak path between the pistons 22 and the wobble plate 16. In addition, the diaphragm 12 may warp or deform less over time, because the pistons 22 can be constructed of a material that is more rigid than the material of the main body 20, which gives more geometric stability to the diaphragm 12.

Pumping chambers through which fluid flows are created on the opposite side of the diaphragm 12 from that which is shown in FIG. 2. The pumping chambers are created between the diaphragm 12 and a valve housing 34. The valve housing 34 is shown and described with respect to FIG. 3. The valve housing 34 mates with the diaphragm 12 in order to create sealed pumping chambers. The diaphragm 12 can be positioned into a sealing relationship with the valve housing 34 via a lip 60 that extends around the perimeter of the diaphragm 12 and a corresponding recess 62 that extends around the perimeter of the valve housing 34. The diaphragm 12 can include raised ridges that correspond to recesses extending around the perimeter of each pumping chamber on the valve housing 34. The raised ridges and the recesses can be positioned together to form a sealing relationship between the diaphragm 12 and the valve housing 34 in order to define each one of the pumping chambers. In some embodiments, the valve housing 34 can include seal beads for added sealing. In other embodiments, the diaphragm 12 does not have raised ridges as just described, but has a sealing relationship with the valve housing 34 to isolate the pumping chambers in other manners. For example, the valve housing 34 can have walls that extend to and are in flush relationship with the diaphragm 12. Alternatively, the pumping chambers can be isolated from one another by respective seals or one or more gaskets positioned between the valve housing 34 and the diaphragm 12.

Figure 3:
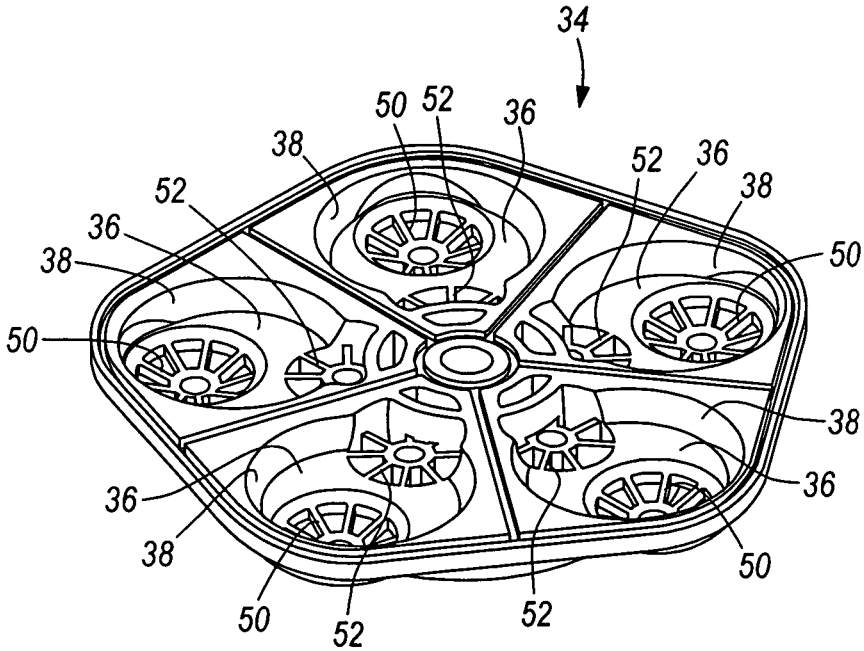
FIG. 3 is a perspective view of a valve housing for use with the drive and diaphragm assembly of FIGS. 1 and 2.

As shown in FIG. 3, the valve housing 34 can include several recessed portions 36 that create the pumping chambers. Each recessed portion 36 can mate with one of the pistons 22 of the diaphragm 12. The opposite side of the pistons 22 from that which is shown and described with respect to FIG. 2 can mate with the recessed portions 36 of the valve housing 34. The recessed portions 36 of the valve housing 34 each include a side wall 38. The side walls 38 can be angled so that the openings of the recessed portions 36 become larger (i.e., the cross-sectional area of the opening increases) as the side walls 38 taper outwardly. In some embodiments, the angled side walls 38 can reduce dead space within the pumping chambers, can improve efficiency, can reduce air entrapment, and can improve priming capability when the pump is initially turned on.

As shown in FIG. 3, each one of the recessed portions 36 can include an inlet aperture 50 and an outlet aperture 52. The inlet apertures 50 and the outlet apertures 52 can be positioned adjacent to valves that allow fluid to flow in only one direction. Fluid can enter each pumping chamber through the inlet apertures 50 and can exit each pumping chamber through the outlet apertures 52. The valves can be disc-shaped flexible elements secured within a valve seat by a snap fit connection between a headed extension of each valve and a central aperture in a corresponding valve seat.

Figure 4:
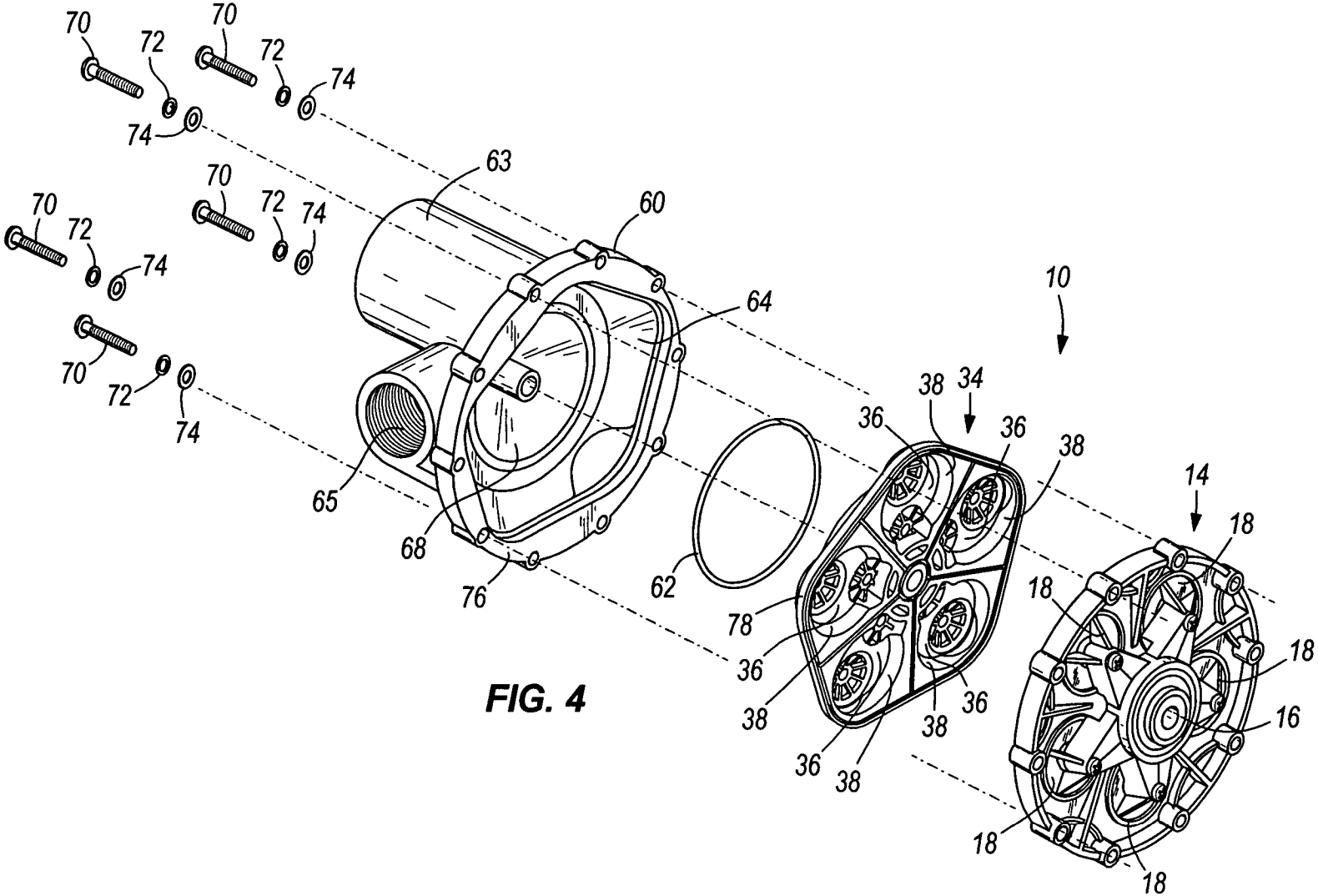
FIG. 4 is an exploded perspective view of the drive and diaphragm assembly of FIGS. 1-2, the valve housing of FIG. 3, and a main housing of a pump.
Figure 12:
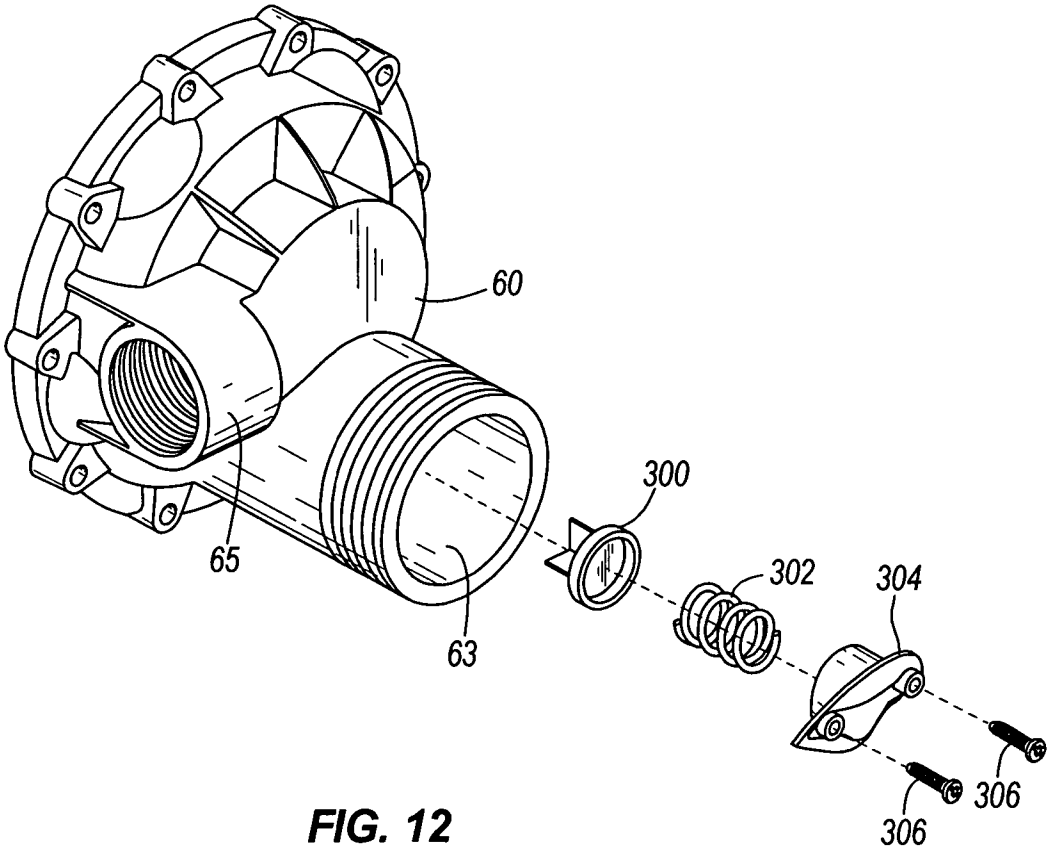
FIG. 12 is a perspective view of a main housing of the pump of FIG. 11.
Figure 13:
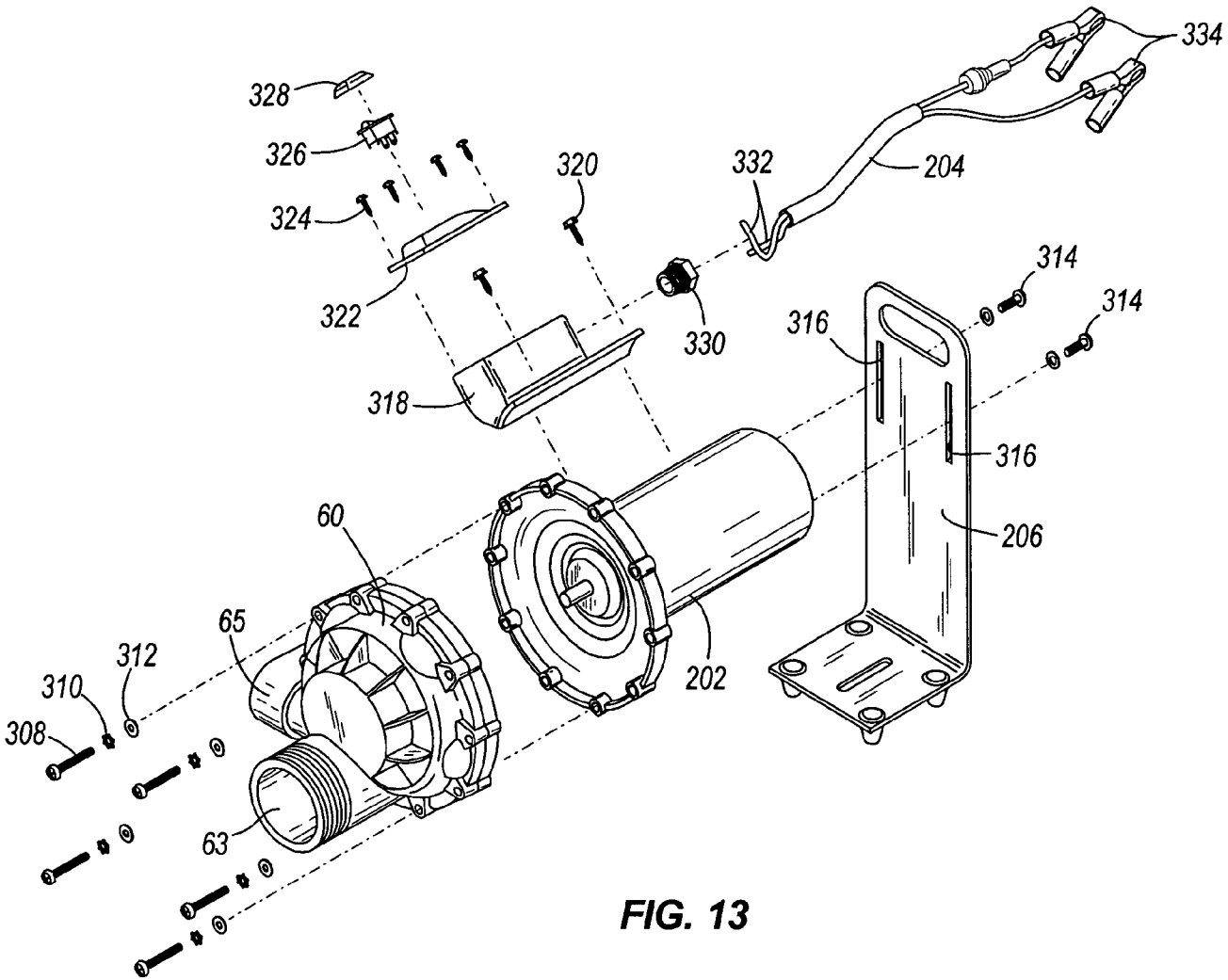
FIG. 13 is an exploded perspective view of the main housing of FIG. 12, a motor assembly, and a power cable assembly according to one embodiment of the invention.

FIG. 4 illustrates the drive and diaphragm assembly 10, a valve housing 34, and a main pump housing 60. An O-ring 62 or any other suitable seal can be positioned between the main pump housing 60 and the valve housing 34. The O-ring 62 can separate the inlet valves of the valve housing 34 and an inlet chamber 64 of the main pump housing 60 from the outlet valves of the valve housing 34 and an outlet chamber 68 of the main pump housing 60. The main pump housing 60 can be secured to the drive and diaphragm assembly 10 and/or a motor housing (not shown) with screws 70, lock washers 72, and plain washers 74, or any other suitable fasteners. The main pump housing 60 can include an annular recess 76 that mates with an edge 78 of the valve housing 34 in order to create an outer seal for the inlet chamber 64. The main pump housing 60 can also include an inlet port 63 and an outlet port 65 (as also shown in FIGS. 11-13).

In operation, movement of the diaphragm 12 causes fluid in the pump to move through the inlet apertures 50 and the outlet apertures 52. When the pistons 22 are actuated by the wobble plate 16, the pistons 22 can move within the pumping chambers in a reciprocating manner. As the pistons 22 move away from the inlet valves, fluid is drawn into the inlet chamber 64 and into the pumping chambers through the inlet apertures 50. The pistons 22 can be actuated sequentially. As the pistons 22 move toward the inlet valves, fluid is pushed out of the pumping chambers through the outlet apertures 52, through the outlet valves, and through the outlet chamber 68.

Figure 5:
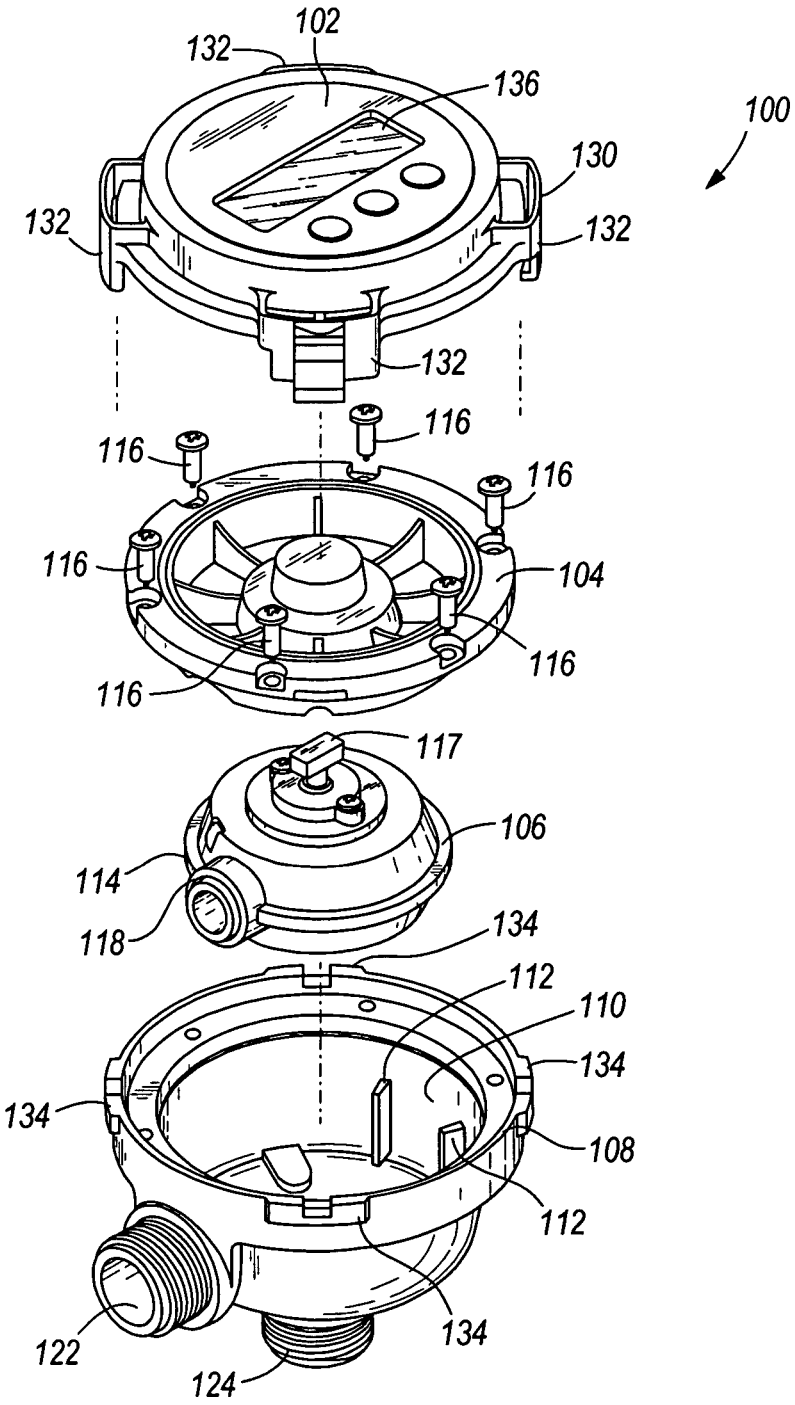
FIG. 5 is an exploded perspective view of a fluid metering unit according to one embodiment of the invention for use with a pump.
Figure 6:
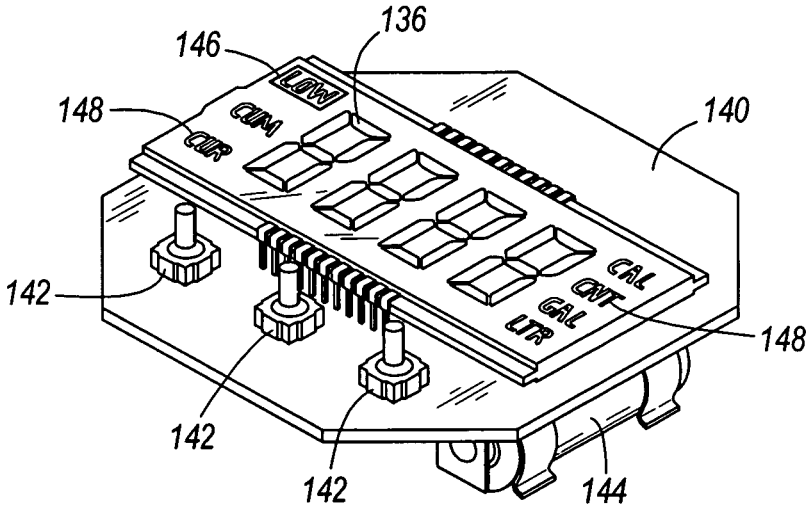
FIG. 6 is a perspective view of a controller of the fluid metering unit of FIG. 5.
Figure 7:
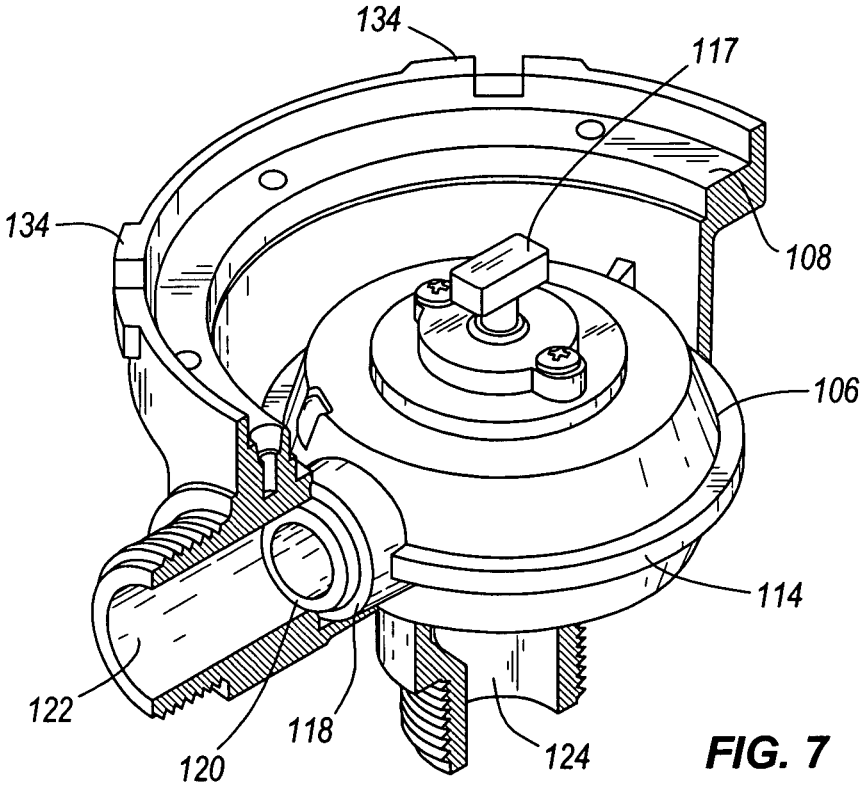
FIG. 7 is a partial perspective view of the fluid metering unit of FIG. 5.
Figure 8:
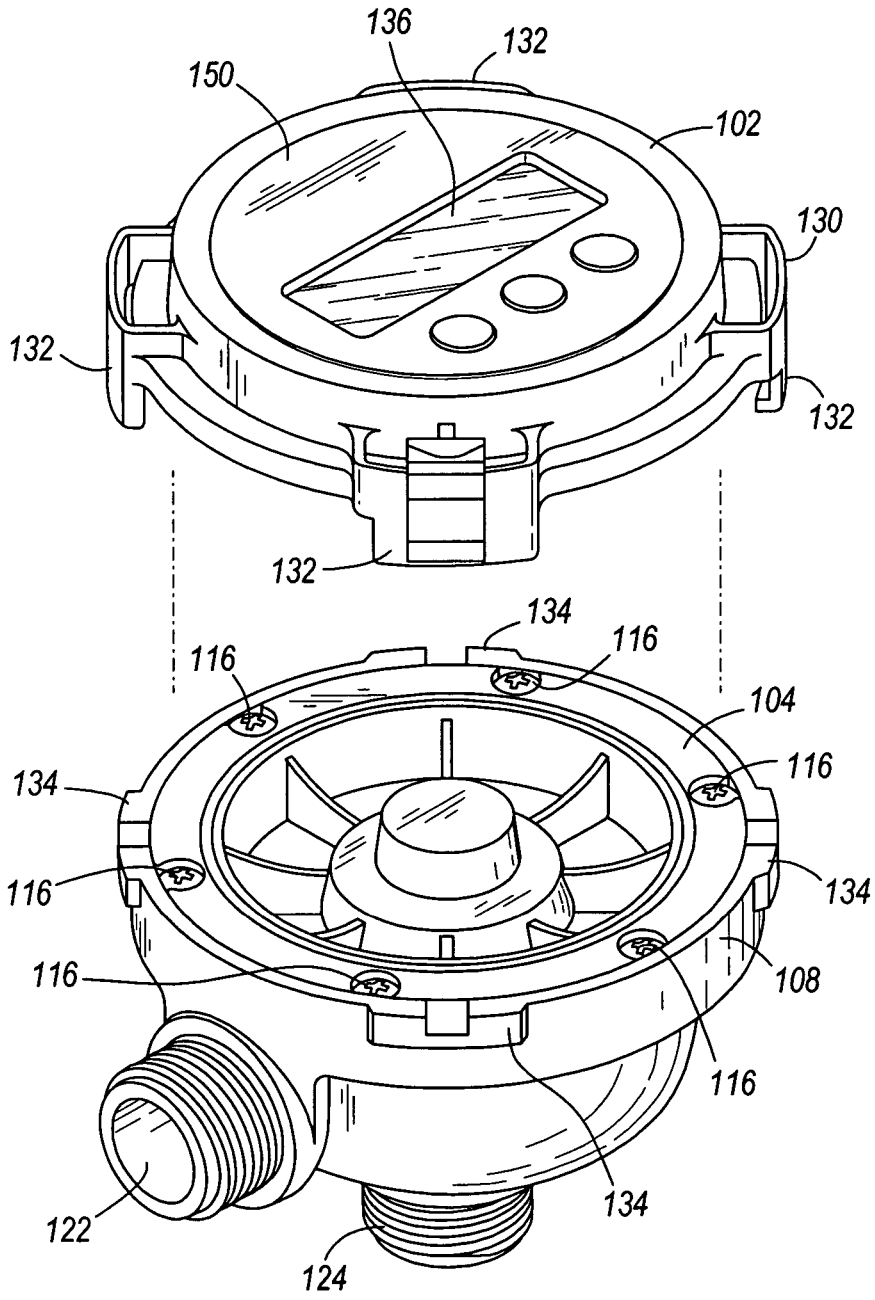
FIG. 8 is a partially exploded perspective view of the fluid metering unit of FIG. 5.
Figure 9:
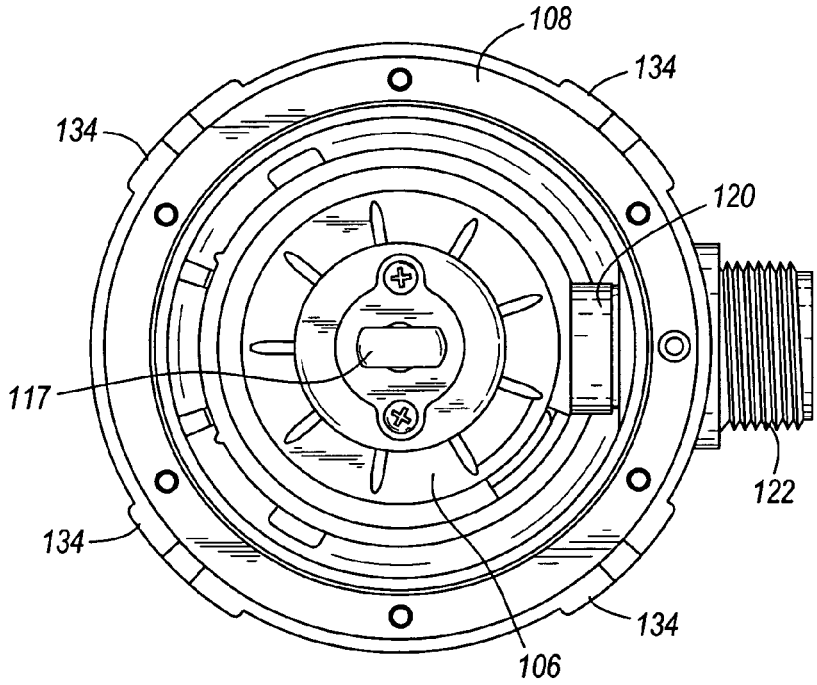
FIG. 9 is a top plan view of the fluid metering unit of FIG. 7.

FIGS. 5-10 illustrate a fluid metering unit 100 according to one embodiment of the invention for use with a pump (such as the pump shown in FIG. 11). As shown in FIG. 5, the fluid metering unit 100 can include a controller 102, a first housing 104, a flow meter 106, and a second housing 108. The flow meter 106 can be positioned within a recess 110 of the second housing 108. The recess 110 can include one or more support members 112 upon which the flow meter 106 can be positioned. For example, the support members 112 can include one or more generally vertical members or a single generally horizontal ridge extending around an interior perimeter of the second housing 108. In order to engage the support members 112, the flow meter 106 can include a generally horizontal flange 114 that can extend around the perimeter of the flow meter 106. The first housing 104 can also engage the flange 114 of the flow meter 106. In some embodiments, the flow meter 106 can be secured with respect to one or both of the first housing 104 and the second housing 108 with a snap-fit connection. In some embodiments, the first housing 104 can be positioned over the flow meter 106 and can be secured to the second housing 108 with screws 116 or any other suitable fastener. FIG. 8 illustrates the first housing 104 secured to the second housing 108 with the screws 116. The flow meter 106 being positioned between the first housing 104 and the support members 112 of the second housing 108 can help prevent the flow meter 106 from moving out of its initial position after installation.

In some embodiments, the flow meter 106 can include a nutating disc flow meter. A nutating disc flow meter includes a precision-machined chamber and a disc that nutates (i.e., wobbles). The position of the disc can divide the chamber into compartments that contain an exact volume. The volumetric accuracy of the fluid metering unit 100 can be improved by high resolution mapping of the rotation of the nutating disc to the number of liters or gallons that are flowing through the flow meter 106. As liquid enters the flow meter 106, liquid pressure drives the disc to wobble and a roller cam causes the nutating disc to make a complete cycle. The compartments are filled and emptied each cycle. The movements of the nutating disc can be transmitted by a gear train to a rotating magnet 117 that can be coupled (either directly or indirectly) to the controller 102. Close clearances between the disc and the chamber can ensure minimal leakage for accurate (e.g., approximately 0.5% accuracy) and repeatable measurement of each volume cycle.

Figure 10:
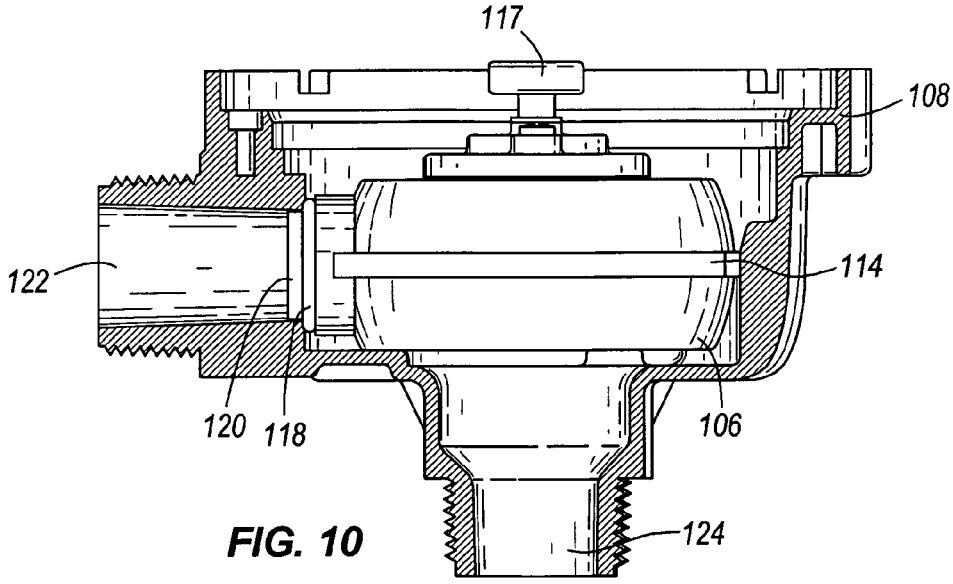
FIG. 10 is a side cross-sectional view of the fluid metering unit of FIG. 7.

The flow meter 106 can include an O-ring 118, in some embodiments. As shown in FIGS. 7 and 10, the O-ring 118 can be positioned around a first outlet port 120 of the flow meter 106. The first outlet port 120 of the flow meter 106 can be positioned within a second outlet port 122 of the second housing 108, with the O-ring 118 creating a seal between the first outlet port 120 and the second outlet port 122. As also shown in FIGS. 7 and 10, the second housing 108 can include an inlet port 124. The flow meter 106 can be positioned to receive fluid from the inlet port 124. The O-ring 118 can prevent a leak path from occurring between the inlet port 124 and the second outlet port 122 of the second housing 108. The O-ring 118 can be held in position as it is compressed by the movement of the nutating chamber of the flow meter 106. The O-ring 118 can be attached to the flow meter 106 before assembly of the pump so that no additional tools are necessary to install the O-ring 118 (i.e., in order to reduce labor costs). The O-ring 118 can also increase the flow efficiency of the flow meter 106.

In some embodiments, the controller 102 can include a bayonet locking mechanism 130 that can be used to secure the controller 102 to the first housing 104 and the second housing 108. As shown in FIG. 8, the bayonet locking mechanism 130 can include one or more extensions 132 that can mate with one of more flanges 134 on the second housing 108. To secure the controller 102 to the second housing 108, the controller 102 can first be positioned so that the extensions 132 are mis-aligned with respect to the flanges 134. The controller 102 can be lowered over the second housing 108 and then rotated so that the extensions 132 engage the flanges 134. In some embodiments, the controller 102 includes four extensions 132 and the main housing 108 includes four corresponding flanges 134 so that the controller 102 can be rotated into one of four positions. The four positions can be provided so that a display 136 of the controller 102 can be properly viewed regardless of the installation position of the pump.

In some embodiments, the extensions 132 and/or the flanges 134 can include ramped portions and/or stepped portions for locking the controller 102 in place. For example, the extensions 132 of the controller 102 can move over a ramped flange 134 in order to tighten the controller 132 onto the second housing 108 as the controller 102 is rotated. Alternatively or in addition, one or more of the extensions 132 can include a stepped portion that moves over one of the flanges 134 and then falls into a corresponding recess on the flange 134, or adjacent to the flange 134, in order to lock the controller 102 into position.

In other embodiments, flanges 134 can be included on the first housing 104, rather than or in addition to the flanges 134 included on the second housing 108. Alternatively, extensions 132 can be included on the first housing 104 or the second housing 108 and flanges 134 can be included on the controller 102.

The bayonet locking mechanism 130 can result in easy assembly and reduced labor costs. The bayonet locking mechanism 130 can allow a user to easily access the controller 102 for maintenance (e.g., replacing the batteries). The bayonet locking mechanism 130 can also help prevent self-reverse locking that can be caused by the vibration of the pump. In addition, the bayonet locking mechanism 130 can provide a seal from the environment and the liquid path of the pump.

The controller 102 can sense the rotation of the magnet 117 (as shown in FIGS. 5 and 7-10). In some embodiments, the magnet 117 can be rod-shaped. As shown in FIG. 6, the controller 102 can include a circuit board 140. The rotation of the magnet 117 can cause a magnetic reed switch mounted on the circuit board 140 to open and close repeatedly. A processor (e.g., a microprocessor, a programmable logic controller, or any other suitable integrated circuit) on the circuit board 140 can count the reed switch's transitions and can calculate an associated volume of liquid that has passed through the nutating disc chamber of the flow meter 106. The processor can transmit the calculated volume to the display 136. The volume can be displayed in gallons or liters. In one embodiment, the display 136 can be a 0.8 inch digit height liquid crystal display (LCD). The displayed volume can be a resettable batch volume or a non-resettable cumulative volume.

In some embodiments, the controller 102 can be calibrated for a specific liquid at a specific temperature. The processor in the controller 102 can include a calibration mode in which the controller 102 will count the number of reed switch transitions for a calibrated volume of liquid. In the calibration mode, a user can pump a fixed volume of liquid through the flow meter 106 into a calibrated container (e.g., a five gallon bucket). The calibration volume range can be approximately 4 to 20 gallons or approximately 15 to 80 liters. After the calibration volume is pumped through the flow meter 106, the user can enter the calibration volume into the controller 102 via push switches 142 and the display 136. A user can press one of the push switches 142 so that the controller 102 calculates the number of gallons per pulse or liters per pulse. In some embodiments, the controller 102 can calculate the gallons per pulse or liters per pulse number to the millionth of a gallon or liter, respectively (i.e., volumetric tracking to six decimal places). The controller 102 can save the gallons per pulse number or the liters per pulse number as its calibration value and can use the calibration value to calculate further flow volume through the flow meter 106. A user can view and change the stored calibration value. A user can also consult a table of calibration values for various liquids at various temperatures, and can change the calibration value saved in the controller 102 according to the table. In some embodiments, the table of calibration values can be generated using values stored in the controller 102. Using a table of calibration values can allow calibration changes without having to pump a calibrated amount of liquid, which increases the accuracy of the controller 102 and productivity.

In some embodiments, the processor of the controller 102 can meet ultra-low-power requirements. The controller 102 can include one or more batteries 144, which can be two replaceable 3 Volt Lithium-Ion batteries, in one embodiment. In some embodiments, the batteries 144 and the ultra-low-power requirements can provide multi-year service life (e.g., four or more years) for the controller 102. The controller 102 can include, in some embodiments, a low-battery indicator 146. The controller 102, in some embodiments, can include a sleep mode that conserves energy when no flow is sensed through the flow meter 106. In some embodiments, the controller 102 can include one or more indicators 148, e.g., CAL (calibration mode), CNT (counts), GAL (display is in gallons), LTR (display is in liters), CUM (cumulative volume total is displayed), CUR (current or batch volume total is displayed). As shown in FIGS. 5 and 8, the controller 102 can include a partially or completely transparent face plate 150 that can be positioned over the display 136 and the push switches 142.

In one embodiment, the push switches 142 can include a MODE or ON switch, an INCREASE switch, and a DECREASE switch. The following paragraphs describe operation of the controller 102 according to one embodiment of the invention in which the controller includes these three push switches. The controller 102 can display and store a resettable CURRENT TOTAL volumetric amount ranging from 0.00 to 9999 volumetric units. The controller 102 can display and store a non-resettable CUMULATIVE TOTAL volumetric amount of 0 to 10,000,000 volumetric units. The displaying of additional units can be accomplished by manually or automatically scrolling the digits left or right. The controller 102 can display and store a counts calibration value or 0 to 9999 counts.

If the CURRENT TOTAL is displayed, a user can press the MODE switch momentarily to turn off the CURRENT TOTAL indicator and turn on the CUMULATIVE TOTAL indicator. The numeric portion of the display 136 can show the flow meter's non-resettable total cumulative volume. If the cumulative is more than four digits (e.g., 1234.56), the number can be displayed by scrolling to the left, starting with the most significant digit. The least significant digit can be followed by blank digits until the display clears, and then the value can scroll across again. After ten seconds in the CUMULATIVE TOTAL display mode, the display can automatically toggle back to showing the CURRENT TOTAL volumetric amount. When a user subsequently presses the MODE switch for less than three seconds while the display is showing the CUMULATIVE TOTAL, the display 136 can revert back to showing the CURRENT TOTAL. A user pressing the DECREASE switch while in the CUMULATIVE TOTAL display mode can display the flow meter's software revision number (e.g., r0.01).

If the display 136 is turned off, a user can press the MODE switch to turn on the CURRENT TOTAL indicator, the four-digit numeric portion of the display 136, and a unit indicator (GALLONS or LITERS). The numeric display and the units indicator can indicate the volume that the meter has measured since the last time it was reset. The CURRENT TOTAL amount can be reset to zero by pressing the DECREASE switch for at least two seconds while the CURRENT TOTAL is displayed.

If the CURRENT TOTAL or CUMULATIVE TOTAL is displayed, a user pressing the MODE switch for at least three seconds can cause the controller 102 to enter the volume unit selection mode. The controller 102 may not enter the volume unit selection mode if it detects that the pump is running. The display 136 can become blank, except for the present volume unit indicator, which can commence flashing once per second. A different volume unit indicator can be selected by pressing the INCREASE or DECREASE switches in order to scroll through the choices (e.g., LITERS, GALLONS, or COUNTS). A user subsequently pressing the MODE switch for less than three seconds can cause the controller 102 to accept any change and return the controller 102 to the CURRENT TOTAL display mode. If the COUNTS indicator was selected, the controller 102 can default back to the previously-selected volumetric unit (e.g., either GALLONS or LITERS).

A user pressing the MODE switch for at least three seconds can place the controller 102 into a calibration mode based on the indicated volume unit. The calibration mode can be used to establish a new COUNT value that the controller 102 can use to accurately measure and display the volume in either GALLONS or LITERS. The COUNT value can vary with the viscosity and temperature of the fluid. The CALIBRATE indicator can turn on and flash along with the selected volume unit indicator. The numeric portion of the display can also turn on, and can display a value according to Table 1 below.

TABLE 1

Numeric display for flashing indicators.

| Flashing Indicators | Numeric Display |
|---|---|
| CALIBRATE LITERS | 20.00 |
| CALIBRATE GALLONS | 5.00 |
| CALIBRATE COUNTS | XXXX |

Note:
An X represents the present value stored in the memory of the controller 102.

To complete the calibration procedure for CALIBRATE LITERS or CALIBRATE GALLONS, a user can pump the exact indicated amount into a calibrated container. Alternatively, a user can pump another amount into a calibrated container, but the numeric display can be changed to match that amount by using the INCREASE or DECREASE switches. To save the calibration, a user can press the MODE switch for at least three seconds until the CALIBRATE indicator turns OFF and the volumetric unit indicator stops blinking. The display 136 can indicate CAL if the calibration was successful. The controller 102 can calculate and save a new COUNTS value, can exit the system edit mode, and can revert to the CURRENT TOTAL display. If a user presses the MODE switch for less than three seconds, the controller 102 may not save any changes and can display ERR (error) to indicate that the calibration was not successful. The controller 102 can return to the CURRENT TOTAL display mode without making any changes to the previous calibration values.

In some embodiments, fluid pumping is not required to complete the calibration procedure for CALIBRATION COUNTS. A user can press the INCREASE or DECREASE switches to change the displayed COUNTS value to a new value. To save the changes, a user can press the MODE switch for at least three seconds until the CALIBRATE and COUNTS indicators turn off and the volumetric unit indicator stops blinking. The controller 102 can save the new COUNTS value, can exit the calibration mode, and can revert to the CURRENT TOTAL display mode. If a user presses the MODE switch for less than three seconds, the controller 102 may not save any changes and can turn itself off to indicate termination of the calibration mode without changes.

The flow meter 106 can turn on the display 136 when flow is detected. The controller 102 can turn off the flow meter 106 and can make the display 136 blank after approximately 32 seconds of switch or flow inactivity. Any unsaved changes may not be saved. In some embodiments, the CUMULATIVE TOTAL cannot be reset, even by removing the batteries 144.

It should be understood by one of ordinary skill in the art that the time periods and sequences for pressing the push switches 142 provided above are by way of example only. It also should be understood that the controller 102 can be programmed to operate in any suitable manner in order to perform the calibration functions described above.

The controller 102 can include a temperature sensor, in some embodiments of the invention. The temperature sensor can provide feedback to the processor for the calibration calculations described above. In some embodiments, the controller 102 can include a viscosity meter that can also provide feedback to the processor for the calibration calculations described above.

FIG. 11 illustrates a pump 200 according to one embodiment of the invention. The pump 200 can include the main pump housing 60 (as also shown in FIG. 4), a motor assembly 202, a power cable assembly 204, and a mounting bracket 206. The fluid metering unit 100 (as also shown in FIGS. 5-10) can be coupled to the outlet port 65 of the pump 200. More specifically, the inlet port 124 (as shown in FIGS. 5, 7, 8, and 10) of the fluid metering unit 100 can be coupled to the outlet port 65 of the pump 200 via a threaded connection or any other suitable connection. Fluid can enter through the inlet port 63 of the pump 200 and fluid can flow out of the outlet port 65 of the pump 200. Fluid can then flow into the inlet port 124 of the fluid metering unit 100 and fluid can flow out of the fluid metering unit 100 through the outlet port 122 (as shown in FIGS. 5 and 7-10) of the fluid metering unit 100.

FIG. 12 illustrates the exterior of the main pump housing 60 according to one embodiment of the invention. The main pump housing 60 can include a bypass poppet 300, a spring 302, a spring retainer 304, and screws 306, each positioned within the inlet port 63.

FIG. 13 illustrates the exterior of the main pump housing 60, the motor assembly 202, the power cable assembly 204, and the mounting bracket 206, according to one embodiment of the invention. The main pump housing 60 can be coupled to the motor assembly 202 with screws 308, lock washers 310, and plain washers 312. The motor assembly 202 can be coupled to the mounting bracket 206 with screws 314 positioned through extended apertures 316. The power cable assembly 204 can include a switch housing 318 coupled to the motor assembly 202 with screws 320. The power cable assembly 204 can also include a switch cover 322 coupled to the switch housing 318 with screws 324. The power cable assembly 204 can further include a rocker switch 326 (or any other suitable switch) and a protection cap 328. The power cable assembly 204 can still further include a strain relief device 330 positioned adjacent to the switch housing 318 and around the power cables 332. In addition, the power cable assembly 204 can include battery connectors 334.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

The invention claimed is:

1. A pump diaphragm for use with a wobble plate pump having a plurality of rocker arms, the pump diaphragm comprising:

a body;

a plurality of pumping chambers;

a plurality of pistons coupled to the body, each one of the plurality of pistons including a piston stem adapted to receive a screw positioned through each one of the plurality of rocker arms;

the body being molded over a portion of each one of the plurality of pistons in order to integrally connect the plurality of pistons to the body, the body including two circular flanges for each one of the plurality of pistons between which each one of the plurality of pistons is positioned, the two circular flanges including one flange on each side of the body for each pumping chamber;

the plurality of pistons being constructed of a plastic that is more rigid than a material of the body.

2. The pump diaphragm of claim 1 wherein the body includes a plurality of convolutes, one of the plurality of convolutes surrounding each one of the plurality of pistons, each one of the plurality of convolutes lying at an angle with respect to the body.

3. The pump diaphragm of claim 1 wherein the plurality of pistons are positioned with respect to the body so that the body is generally in the shape of a pentagon.

4. The pump diaphragm of claim 1 wherein the plurality of pistons are positioned with respect to the body so that the body is generally in the shape of a triangle.

5. The pump diaphragm of claim 1 wherein the body is constructed of a thermoplastic elastomer.

* * * * *